US005345705A

United States Patent [19]

Lawrence

[11] Patent Number: 5,345,705

[45] Date of Patent: Sep. 13, 1994

[54] LIGHTWEIGHT, THREE-DIMENSIONAL SIGN

[76] Inventor: Gary L. Lawrence, 8036 Bricker Rd., NW., Massillon, Ohio 44646

[21] Appl. No.: 101,332

[22] Filed: Aug. 2, 1993

Related U.S. Application Data

[63] Continuation of Ser. No. 886,522, May 20, 1992, abandoned.

[51] Int. Cl.[5] ..... G09F 19/00

[52] U.S. Cl. ..... 40/616; 40/160; 40/455; 40/541; 40/594; 362/800; 362/812; 428/13; 428/71

[58] Field of Search ..... 40/160, 455, 541, 552, 40/594, 615, 616, 906; 362/86, 800, 812; 428/13, 71

[56] References Cited

U.S. PATENT DOCUMENTS

| | | | |
|---|---|---|---|
| 2,147,748 | 2/1939 | Miller . | |
| 2,756,528 | 7/1956 | Silver | 40/616 |
| 2,859,152 | 11/1958 | Markus | 40/616 X |
| 3,093,918 | 6/1963 | Krakauer et al. | 40/616 X |
| 3,409,765 | 11/1968 | Trame . | |
| 3,416,765 | 12/1968 | Ebner . | |
| 3,566,525 | 3/1971 | Nassil et al. | 40/552 |
| 3,593,447 | 7/1971 | Winegarten . | |
| 4,055,909 | 11/1977 | Perry | 40/124.2 |
| 4,096,656 | 6/1978 | Diceglie . | |
| 4,536,423 | 8/1985 | Travis | 40/594 X |
| 4,584,218 | 4/1986 | Travis | 40/594 X |
| 4,848,015 | 7/1989 | Allen . | |
| 4,883,692 | 11/1989 | Spector | 428/71 X |
| 4,910,280 | 3/1990 | Robbins, III | 428/71 |
| 4,934,078 | 6/1990 | Sloot . | |
| 4,934,079 | 6/1990 | Hoshi | 40/455 X |
| 4,963,408 | 10/1990 | Huegli | 428/71 |
| 4,970,812 | 11/1990 | Tanaka et al. . | |

*Primary Examiner*—Brian K. Green
*Attorney, Agent, or Firm*—Hudak & Shunk Co.

[57] ABSTRACT

A durable, lightweight sign or display device having a desired three-dimensional, contoured surface and a self-sticking backing to facilitate easy mounting is disclosed. The sign has a rigid plastic display sheet which is formed into the desired three-dimensional, contoured surface and formed with a peripheral flange. A plastic backing is heat-sealed to the display sheet along its peripheral flange. Pressure-sensitive adhesive is applied to the outer surface of the backing and a removable protective layer is used to cover the adhesive to prevent contamination thereof prior to use. The sign is relatively inexpensive to fabricate and mass-produce. The sign is ideally suited for temporary display purposes such as sales, promotions, or seasonal decorations.

20 Claims, 2 Drawing Sheets

LIGHTWEIGHT, THREE-DIMENSIONAL SIGN

This application is a file wrapper continuation of application Ser. No. 07/886,522, filed on May 20, 1992, now abandoned, by Gary L. Lawrence for LIGHTWEIGHT, THREE-DIMENSIONAL SIGN.

FIELD OF INVENTION

The present invention relates to a sign or display device for advertising or ornamental uses and more particularly to a lightweight sign which is easy to mount and remove, having a three-dimensional display surface.

BACKGROUND

Conventional signage used for temporary advertising promotions and temporary decorative displays have heretofore generally consisted of placards, banners, posters, and the like having a two-dimensional display surface. Such two-dimensional displays are not as visually stimulating and do not attract the same attention as a three-dimensional display. Temporary signs having a two-dimensional display surface are generally fabricated from paper, cardboard, or flexible plastic and are, therefore, generally not well suited for extended outdoor use. Moreover, conventional temporary signs cannot be used in association with various interest enhancement devices such as internal lighting means and internal audio means. Another disadvantage with conventional temporary signage is that separate mounting means such as adhesive tape, nails, tacks, string, or other fasteners are usually required.

Known signs having a three-dimensional display surface are generally relatively heavy, difficult to mount, expensive to fabricate, and, therefore, not particularly well suited for temporary display purposes.

SUMMARY OF THE INVENTION

The invention relates to a decorative, lightweight sign or display device having a visually stimulating three-dimensional display surface. The three-dimensional display or relief surface of the sign gives shape and definition to the products, objects, or content displayed, thus attracting the attention of casual viewers and inviting them to focus on and study the content and subject matter of the sign.

The sign comprises a rigid plastic display sheet which is formed to have the desired three-dimensional features or contours, and which is secured to a plastic backing. The space between the contoured display sheet and the backing can be filled with a foamed plastic material having a sufficient rigidity to provide support and dimensional stability for the display surface. The sign is lightweight and relatively inexpensive to fabricate, making it ideally suited for use as a temporary display as for sales, promotions, or seasonal decorations.

The display sheet and backing can be transparent, translucent, or opaque, as desired. Depending on what is desired, the display sheet and backing can be clear, colored, or tinted. Written messages and other indicia can be printed directly on the inner or outer surfaces of the display sheet and backing. Alternatively, written messages and other indicia can be printed on paper, cardboard, plastic, or other materials which are contained within the sign and viewable through a transparent display sheet or backing.

In accordance with an aspect of the invention pressure-sensitive adhesive is applied to the backing and covered with a removable protective layer to provide a self-sticking sign which facilitates easy mounting and removal from smooth, planar surfaces such as windows or mirrors.

Optionally, the invention can be provided with various features which will increase the noticeability of the sign and further enhance and intensify a viewer's interest therein. Optional features include lighting means, audio means, or olfactory stimulus contained within the sign.

In accordance with another aspect of the invention, a plastic pocket(s) having an opening can be secured to the display sheet to facilitate insertion and removal of supplemental signage.

Despite its striking appearance, the sign is relatively simple in construction and can be inexpensively mass produced using automated techniques.

DETAILED DESCRIPTION OF THE INVENTION

Figure 1:
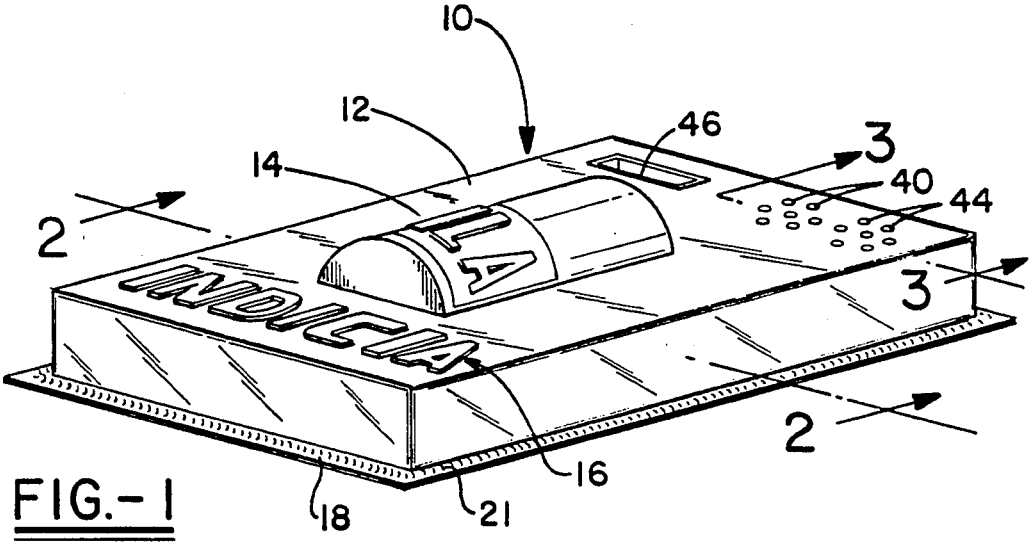
FIG. 1 is a perspective view of a sign in accordance with the teachings of the invention.

Referring to the figures and in particular FIG. 1, the sign 10 comprises a rigid plastic display sheet 12 which is vacuum-formed to have a desired three-dimensional contoured display surface. Other conventional techniques can be used to form the desired contours such as pressure molding or thermoforming. The rigid plastic display sheet 12 is preferably polyvinyl chloride (PVC), but other formable rigid plastics can also be used. The contours 14 can include raised portions which resemble an article, such as a product or a container, or raised lettering 16. A suitable starting thickness for the rigid plastic display sheet 12 is typically about 0.020 inch. However, as the sheet 12 is contoured to the desired three-dimensional form, plastic flows within the sheet 12 causing variations in the thickness. More complex contours cause more plastic to flow during the forming process resulting in greater thickness variations of the fully contoured sheet 12. Thus, thicker sheets may be required when the three-dimensional display is more complex.

The display sheet 12 is preferably formed with a peripheral flange 18. The display sheet 12 is secured along its peripheral flange 18 to a plastic backing 20. The plastic backing is preferably a rigid or semi-rigid plastic such as PVC. A suitable thickness for the backing material is about 0.004 inch. The display sheet 12 can be secured to the backing 20 by various known means such as adhesives, clips, or stapes, but is preferably fused thereto. The display sheet 12 can be fused to the backing 20 by various conventional techniques such as electronic fusion, heat and pressure, radio frequency heating, ultrasonic melt welding, and the like. A continuous fused seam 21 along the peripheral flange 18 results in a sealed sign which is particularly well suited for outdoor and high humidity applications.

The display sheet 12 is preferably clear or transparent, but can be tinted, translucent, or opaque. Written messages and other indicia can be applied directly to the inner or outer surfaces of the display sheet, if desired, using conventional techniques. For example, printed matter can be applied to the inner or outer surface of the display sheet 12, before or after it is contoured, with a suitable PVC receptive ink to form desirable patterns, designs or written messages. Such inks are well known and can be applied by various methods of printing such as by gravure, flexography, screen printing, jet printing, web printing and the like. Multiple printing operations can be utilized to provide multiple color designs.

In accordance with the preferred embodiment, written messages and other indicia are printed or embossed on one or more sheets 22 of cardboard, paper, cloth, plastic, or the like. Before the display sheet is secured to the backing, the printed sheets 22 are suitably cut, scored, folded, and positioned against the clear, contoured display sheet 12 with the printed or embossed side of the sheets 22 facing the inner wall of the display sheet 12, so that the printed or embossed matter can be viewed from the outside of the display sheet.

In accordance with a preferred aspect of the invention, the backing is transparent, and printed material appears on a sheet 23 with the printed side facing the inner wall of the backing 20 so that the printed matter can be viewed from the outside of the backing. The resulting two-sided sign can be secured to a window or glass partition so that advertisements or ornamentation can be viewed from either side of the sign.

Foamed plastic 24 having sufficient rigidity is preferably disposed within the void spaces of the sign prior to securing the display sheet to the backing to help keep the printed sheets in proper position and to add dimensional stability and rigidity to the sign. The foamed plastic 24 is preferably an expanded rigid polystyrene plastic, and can be cut, molded in situ, or molded separately to conform to the void space of the sign.

A pressure-sensitive adhesive 26 is disposed over the outside surface of the backing and covered with a removable protective layer 28 which prevents contamination and loss of the adhesive prior to the use thereof. A suitable adhesive has an adhesive strength which is sufficient to bond the sign to a smooth surface for an extended period of time without the sign falling off under its own weight or on account of exposure to moderately severe weather or vibrations. The removable protective layer 28 or release layer can be any conventional material used to protect adhesives applied to a surface prior to use, such as wax or silicone-coated paper. While the adhesive 26 and protective layer 28 can be applied after the display sheet 12 is secured to the backing 20, it is preferable to obtain a plastic backing material having the adhesive 26 and protective layer 28 already layered together. Plastic sheeting having an adhesive and a protective layer on one side which is suitable for use as the backing 20 for the invention are readily available commercially.

A pocket 46 having an opening can be secured to the outer surface of the display sheet 12 to facilitate insertion and removal of supplemental signage, as for example a printed card bearing a price. The pocket 46 is preferably fabricated from a pair of overlapping flexible plastic panels which are fused together along three edges.

Optional lighting means such as a light-emitting diode 30 connected to a battery 32 by means of electrical conductors 34 can be employed to visually enhance the sign's ability to attract a viewer's attention. Lighting means can be used in association with circuitry for regulating individual lights or a plurality of lights in timed sequences to further increase the attractiveness of the sign. The lighting means can be powered by an internal or external power source and can be provided with external control means.

Another optional feature which adds to the ability of the sign to attract attention is audio means such as a speaker 36 secured to an inside surface of the display sheet 12 and electrically connected to a magnetic or digital audio record player 38. A plurality of miniature openings 40 permit sound to pass from the speaker through the display sheet 12.

Olfactory stimuli can also be used in association with the sign to enhance its attractiveness. For example, an odorized or scented pad 42 can be secured to the inside surface of the display sheet 12. Adjacent miniature openings 44 permit the scent from the pad 42 to emanate from the sign and to be detected by a person in proximity to the sign.

Figure 2:
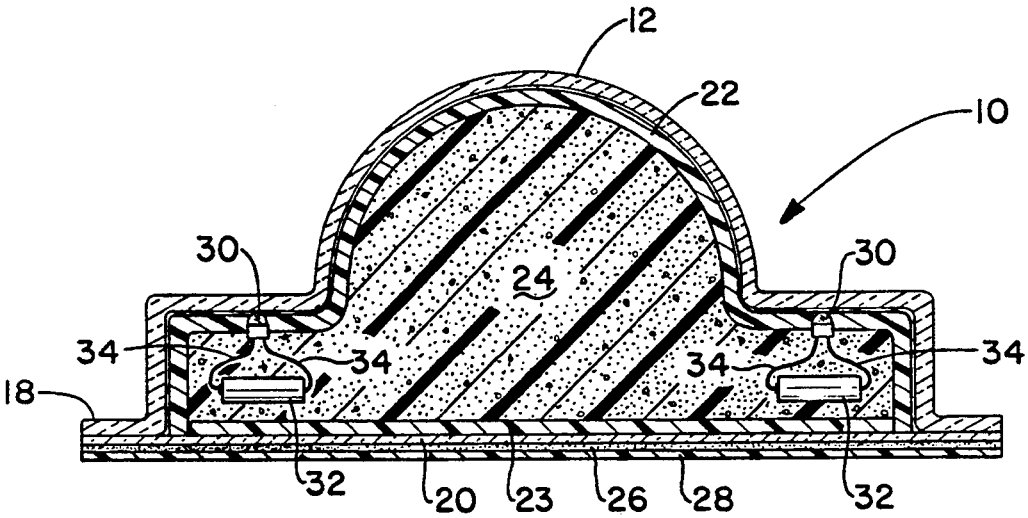
FIG. 2 is a section as viewed along lines 2—2 of FIG. 1.
Figure 3:
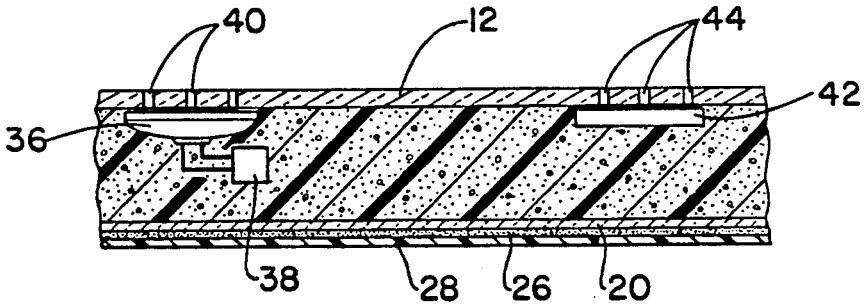
FIG. 3 is an enlarged section as viewed along lines 3—3 of FIG. 1.
Figure 4:
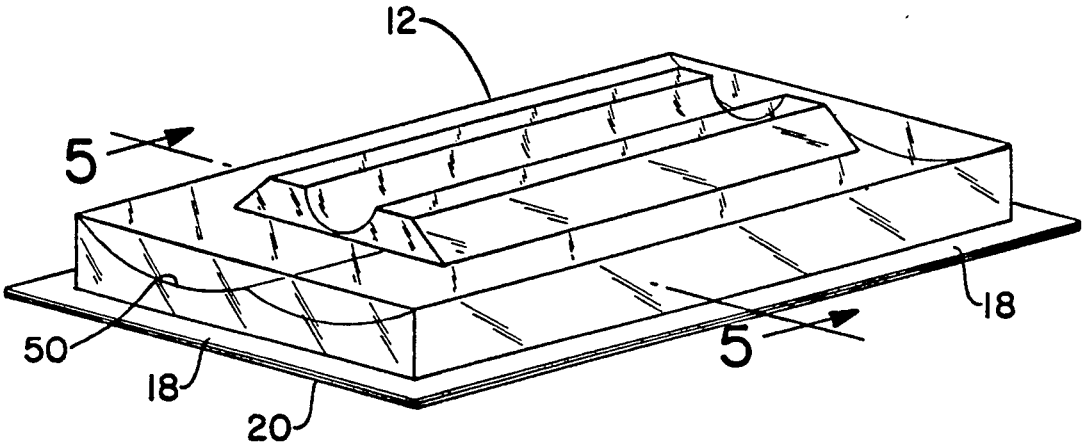
FIG. 4 is a perspective view of a second embodiment of the invention.

A second embodiment of the invention having features generally similar to those of the first embodiment is shown in FIG. 4. The sign has an at least partially transparent contoured display sheet 12 formed with a peripheral flange 18, a plastic backing 20 preferably having an adhesive coating 26 and a protective layer 28. However, the sign differs from the first embodiment shown in FIGS. 1–3 by having a secondary display surface 50 disposed within the sign at least partially in spaced relationship with the face of contoured display sheet 12. By having a secondary display surface 50 spaced away from the inner surface of display sheet 12, an enhanced three dimensional effect is achieved thereby increasing the signs attractiveness and stimulating interest therein. The secondary display surface 50 can be cardboard, paper, cloth, plastic or the like, on to which written messages or other indicia are printed or embossed. A foamed plastic filler 24 can be used as a support for the display surface 50 to keep it in its proper position. The secondary display surface 50 can be contoured such as is shown in FIG. 4 to give the sign a very striking three dimensional appearance.

Figure 5:
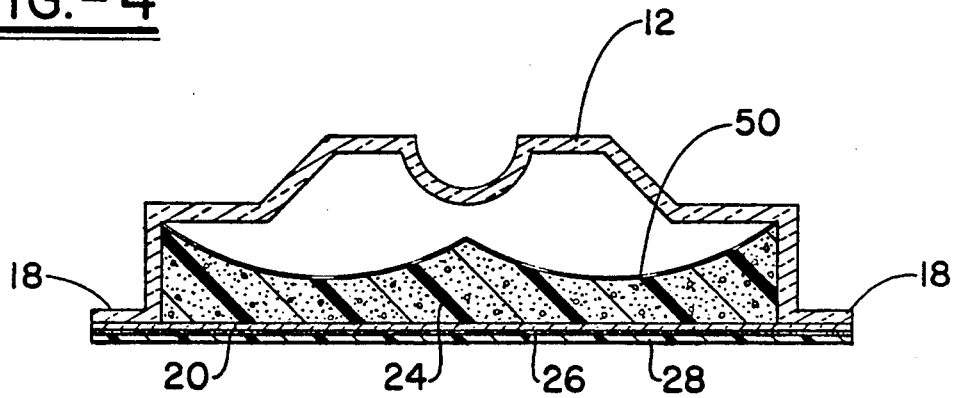
FIG. 5 is a section as viewed along lines 5—5 of FIG. 4.
Figure 6:
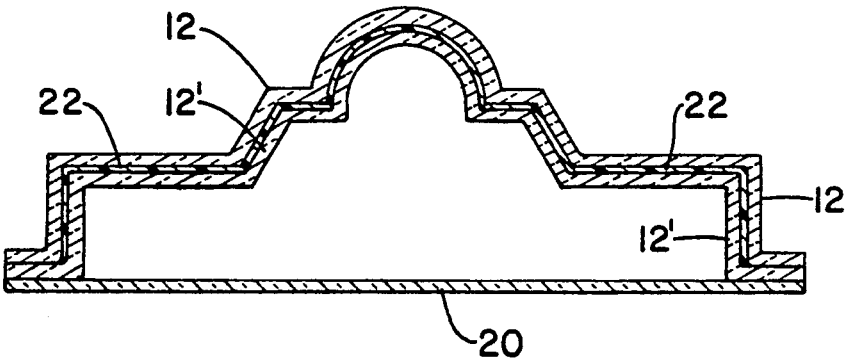
FIG. 6 is an enlarged sectional view of a third embodiment of the invention.

In accordance with a third embodiment of the invention, printed matter 22 can be sandwiched between a pair of nested rigid plastic sheets 12 and 12'. The outer display sheet 12 is contoured or formed to provide a three dimensional display surface as usual. A second substantially conforming sheet 12' is used to hold the printed matter 22 in position against the outer display sheet 12 and to provide additional rigidity to the sign, thus functionally serving as an alternative to the optional foamed plastic 24 shown in FIGS. 2 and 5. The sheets 12 and 12' each have peripheral flanges which are fused together and to the backing 20. The various options and features disclosed with respect to the first two embodiments, such as printing on and embossing the display sheet, incorporation of printed matter viewable through a transparent backing, incorporation of audio, lighting and olfactory stimuli, pressure sensitive adhesive disposed on the outer surface of the backing, etc., can be utilized in association with the third embodiment.

While in accordance with the Patent Statutes, the best mode and preferred embodiment has been set forth, the scope of the invention is not limited thereto, but rather by the scope of the attached claims.

What is claimed is:

1. A sign comprising a rigid plastic display sheet having a desired three-dimensional, contoured display surface formed thereon, the display sheet being secured to a planar plastic backing and together with the planar plastic backing defining a space therebetween a rigid foamed plastic at least partially occupying the space between the planar plastic backing and the display sheet, the rigid foamed plastic having sufficient rigidity to provide support and dimensional stability for the contoured display surface of the display sheet, and matter contained within the space between the display sheet and the backing, said matter having a display surface, a portion of the display sheet being transparent to allow viewing of said display surface of said matter contained within the sign.

2. A sign as set forth in claim 1, wherein a pressure-sensitive adhesive is applied to at least a portion of an outer surface of the backing.

3. A sign as set forth in claim 2, wherein a removable protective layer covers that portion of the outer surface of the backing having the pressure-sensitive adhesive applied thereto, to protect the adhesive from contamination prior to use.

4. A sign as set forth in claim 1, wherein the display sheet is formed with a peripheral flange, and wherein the display sheet is secured to the backing along the peripheral flange.

5. A sign as set forth in claim 4, wherein the display sheet is continuously and sealingly secured to the backing along the peripheral flange of the display sheet.

6. A sign as set forth in claim 4, wherein the display sheet is continuously and sealingly fused to the backing.

7. A sign as set forth in claim 1, further comprising lighting means contained within the space between the display sheet and the backing, and wherein at least a portion of the display sheet is capable of transmitting light to allow viewing of light emitted from the lighting means.

8. A sign as set forth in claim 1, further comprising audio means contained within the space between the display sheet and the backing, and wherein at least a portion of the display sheet is capable of allowing sound generated within the sign to be heard outside of the sign.

9. A sign as set forth in claim 1, further comprising olfactory stimulus contained within the space between the display sheet and the backing, and wherein at least a portion of said display sheet is adapted to permit detection of the olfactory stimulus by a person in proximity with the sign.

10. A sign as set forth in claim 1, further comprising at least one pocket secured to an outer surface of the display sheet, the at least one pocket having a transparent window and an opening for insertion and removal of supplemental signage.

11. A sign as set forth in claim 1, wherein the rigid plastic display sheet is formed from a plastic sheet having a thickness of about 0.020 inch, and wherein the plastic backing has a thickness of about 0.004 inch.

12. A sign as set forth in claim 1, wherein the foamed plastic is an expanded rigid polystyrene plastic.

13. A sign comprising a rigid plastic display sheet having a desired three-dimensional, contoured display surface and a peripheral flange, the display sheet being fused to a planar plastic backing along the peripheral flange and together with the planar plastic backing defining a space therebetween, a rigid foamed plastic at least partially occupying the space between the planar plastic backing and the display sheet, the rigid foamed plastic having sufficient rigidity to provide support and dimensional stability for the contoured display surface of the display sheet, and matter contained within the space between the display sheet and the backing, at least a portion of the display sheet being transparent to allow viewing of said display surface of said matter contained within the sign.

14. A sign as set forth in claim 13, further comprising a second rigid plastic sheet having a contoured surface which substantially conforms to the size and shape of the display sheet, the second sheet being nested with the first sheet with the matter sandwiched therebetween, each of the nested sheets having a peripheral flange, the two nested sheets being fused together and to the plastic backing along the peripheral flanges.

15. A sign as set forth in claim 13, further comprising a pressure-sensitive adhesive applied to at least a portion of an outer surface of the backing, and a removable protective layer which covers that portion of the outer surface of the backing having the pressure-sensitive adhesive applied thereto.

16. A sign as set forth in claim 13, further comprising printed matter contained within the space between the display sheet and the backing, and wherein at least a portion of the backing is transparent to allow viewing of the printed matter contained within the sign.

17. A sign as set forth in claim 15, further comprising at least one pocket secured to an outer surface of the display sheet, the at least pocket having a transparent window and an opening for insertion and removal of supplemental signage.

18. A sign comprising a rigid, plastic display sheet formed in to a desired three-dimensional, contoured display surface and formed with a peripheral flange, a plastic backing heat-sealed to the display sheet along the peripheral flange and together with the display sheet defining a space therebetween, a rigid foamed plastic at least partially occupying the space between the planar plastic backing and the display sheet, the rigid foamed plastic having sufficient rigidity to provide support and dimensional stability for the contoured display surface of the display sheet, pressure sensitive adhesive applied to at least to a portion of an outer surface of the backing, a removable protective layer which covers the portion of the outer surface of the backing having the pressure sensitive adhesive applied thereto, and printed matter contained within the space between the display sheet and the backing, at least a portion of the display sheet being transparent to allow viewing of the printed matter contained within the sign.

19. A sign as set forth in claim 18, wherein the printed matter is at least partially spaced away from the display sheet.

20. A sign as set forth in claim 19, wherein the printed disposed within the sign is contoured to have a relief surface.

* * * * *